US010926544B2

(12) United States Patent
Balala et al.

(10) Patent No.: US 10,926,544 B2
(45) **Date of Patent: *Feb. 23, 2021**

(54) PRINTER HAVING PLATEN WITH PARTICLE AND INK COLLECTION SLOTS

(71) Applicant: MEMJET TECHNOLOGY LIMITED, Dublin (IE)

(72) Inventors: Rommel Balala, North Ryde (AU); Dan Baterna, North Ryde (AU)

(73) Assignee: Memjet Technology Limited

( * ) Notice: Subject to any disclaimer, the term of this patent is extended or adjusted under 35 U.S.C. 154(b) by 0 days.

This patent is subject to a terminal disclaimer.

(21) Appl. No.: 16/584,151

(22) Filed: Sep. 26, 2019

(65) Prior Publication Data

US 2020/0016900 A1 Jan. 16, 2020

Related U.S. Application Data

(63) Continuation of application No. 15/977,992, filed on May 11, 2018, now Pat. No. 10,464,328.

(60) Provisional application No. 62/527,929, filed on Jun. 30, 2017, provisional application No. 62/505,736, filed on May 12, 2017.

(51) Int. Cl.
*B41J 2/17* (2006.01)
*B41J 2/185* (2006.01)

(52) U.S. Cl.
CPC ..... *B41J 2/1714* (2013.01); *B41J 2/1721* (2013.01); *B41J 2/185* (2013.01)

(58) Field of Classification Search
CPC ..... B41J 2/1714; B41J 2/1721; B41J 2/185
USPC ..... 347/34
See application file for complete search history.

*Primary Examiner* — Huan H Tran
*Assistant Examiner* — Alexander D Shenderov
(74) *Attorney, Agent, or Firm* — Cooley LLP

(57) ABSTRACT

A printer includes: a printhead; a platen positioned below the printhead for supporting print media conveyed along a media feed direction through a print zone, the platen defining at least one particle-collection slot upstream of the print zone relative to the media feed direction and an ink-collection slot positioned in the print zone downstream of the particle-collection slot. A dam wall is positioned between the particle-collection slot and the ink-collection slot, with the dam wall extending transversely relative to the media feed direction.

20 Claims, 10 Drawing Sheets

PRINTER HAVING PLATEN WITH PARTICLE AND INK COLLECTION SLOTS

CROSS-REFERENCE TO RELATED APPLICATIONS

The present application is a Continuation Application of U.S. application Ser. No. 15/977,992 filed May 11, 2018, which claims the benefit of priority under 35 U.S.C. § 119(e) of U.S. Provisional Application No. 62/505,736, entitled MIST EXTRACTION SYSTEM FOR INKJET PRINTHEAD, filed May 12, 2017 and of U.S. Provisional Application No. 62/527,929, entitled PARTICLE COLLECTION SYSTEM FOR AN INKJET PRINTER, filed Jun. 30, 2017, the contents of each of which are hereby incorporated by reference in their entirety for all purposes.

FIELD OF THE INVENTION

This invention relates to a mist extraction and particle collection system for an inkjet printhead. It has been developed primarily for improving print quality by reducing mist artefacts, whilst minimizing a space occupied by the mist extraction and particle collection systems.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

Ink mist (or ink aerosol) is a perennial problem in inkjet printers, especially high-speed, pagewide inkjet printers where microscopic ink droplets are continuously jetted onto passing media. Ink mist can result in a deterioration in print quality and may build up over time during longer print jobs.

Mist extraction systems generally employ suction above and/or below a media platen to remove mist from the vicinity of the printhead. For example, US 2011/0025775 describes a system whereby ink aerosol is collected via vacuum collection ports positioned above and below the media platen.

Mist extraction systems having a vacuum collection port above the media platen are usually more efficient at reducing ink mist. Such systems continuously extract ink mist from the vicinity of the printhead during printing. However, above-platen mist extraction systems have the drawback of occupying a relatively large amount of space in the printer. In printers having a plurality of pagewide printheads, it is desirable to minimize a spacing between adjacent printheads in the media feed direction and above-platen mist extraction systems can impact this critical spacing.

On the other hand, below-platen mist extraction systems do not impact on printhead spacing, but such systems are relatively inefficient. Since suction is applied through aperture(s) in the media platen, opportunities for mist extraction only arise between printing onto sheets of media and it is difficult encourage ink mist into platen apertures during a relatively short inter-page time period, especially during high-speed printing. Furthermore, an increase in suction pressure is generally not viable, because the suction pressure at the platen surface must be low enough to enable smooth feeding of print media over the platen surface during printing.

It would be desirable to provide an efficient mist extraction system, which occupies a relatively small space in a printer. It would further be desirable to provide a mist extraction system, which does not impact on the spacing between printheads in a printing system having multiple printheads.

SUMMARY OF THE INVENTION

In a first aspect, there is provided a printer comprising:

- a platen having an ink-collection slot extending at least partially across a width thereof;
- a wick bar received in the ink-collection slot, wherein an upstream gap and a downstream gap are defined at either side of the wick bar relative to a media feed direction;
- a printhead positioned at least partially over the wick bar; and
- a vacuum chamber in fluid communication with the ink-collection slot, wherein the wick bar has a wick surface sloped upwards from the upstream gap towards the downstream gap.

The printer according to the first aspect advantageously reduces mist levels in the vicinity of the printhead, especially when compared to otherwise identical printers lacking the wick bar.

Preferably, the wick bar is recessed within the ink-collection slot.

Preferably, the upstream gap is wider than the downstream gap.

Preferably, the ink-collection slot has sidewalls extending towards the vacuum chamber.

Preferably, a lower end of at least one sidewall has a guard for minimizing ink migration along a lower surface of the platen.

Preferably, a downstream sidewall is chamfered from the platen surface towards the wick bar.

Preferably, the downstream sidewall is chamfered at an angle of between 5 and 20 degrees.

Preferably, at least one of the sidewalls flares outwardly towards the vacuum chamber.

Preferably, the wick surface is sloped upwards at between 1 and 10 degrees relative to a plane parallel with the platen.

Preferably, the wick surface is positioned below a platen surface of the platen.

Preferably, an upstream longitudinal edge region of the wick surface is curved.

Preferably, a downstream longitudinal edge of the wick surface is angular.

Preferably, the platen comprises a plurality of ribs for supporting print media, and wherein a platen surface comprises upper surfaces of the ribs.

Preferably, the platen defines a plurality of vacuum apertures for drawing print media onto the platen surface.

In an alternative embodiment, the wick bar is absent from a mid-portion of the platen. The mid-portion of the platen absent the wick bar is preferably aligned, in the media feed direction, with an upstream media picker.

In some embodiments, the printer comprises first and second printheads, wherein the platen has first and second ink-collection slots extending at partially along a width thereof and each ink-collection slot has a respective wick bar received therein. In this embodiment, the first and second printheads are positioned over respective wick bars.

It is an advantage of the present invention that mist extraction via platen slots does not affect the spacing between printheads. Accordingly, this spacing can be minimized without having to accommodate an above-platen mist extraction system.

The first and second printheads may be positioned in an overlapping arrangement with respect to the media feed direction.

Typically, the platen extends between the first and second printheads and defines a common platen surface for supporting print media fed past the first and second printheads.

Preferably, the platen extends between the first and second printheads and defines a common surface for supporting print media in the first and second print zones.

Preferably, the platen is a vacuum platen.

Preferably, the printheads are inkjet printheads and may comprise a plurality of printhead chips based on pagewide printing technology.

In a second aspect, there is provided a printer comprising:

a printhead;

a platen positioned below the printhead for supporting print media conveyed along a media feed direction through a print zone, the platen defining at least one particle-collection slot upstream of the print zone relative to the media feed direction; and a vacuum chamber in fluid communication with the particle-collection slot, wherein:

an upper surface of the platen comprises a plurality of raised ribs extending along the platen in the media feed direction and a dam wall extending across the platen transverse to the ribs;

the dam wall is positioned at a downstream side of the particle-collection slot; and the ribs extend towards the dam wall from an upstream side of the particle-collection slot.

The printer according to the second aspect advantageously protects the print zone of the printer from the deleterious effects of particles, such as paper dust.

Preferably, the platen has an ink-collection slot extending parallel with the dam wall, the ink-collection slot being positioned in the print zone downstream of the dam wall.

Preferably, the dam wall divides the ink-collection slot from the particle-collection slot.

Preferably, a wick bar is received within the ink-collection slot.

Preferably, upper surfaces of the ribs and dam wall are coplanar.

Preferably, the particle-collection slot is divided into a plurality of discrete particle-collection traps.

Preferably, each rib bridges across the particle-collection slot and meets with the dam wall.

Preferably, each rib terminates at an upstream side of the particle-collection slot.

Preferably, each rib has an end portion curved downwards towards the particle-collection slot.

Preferably, a plurality of fins extend from the dam wall parallel with the ribs, each fin bridging across the particle-collection slot.

Preferably, the fins are offset from the ribs.

Preferably, each rib is disposed midway between a pair of fins.

Preferably, a portion of the dam wall and a pair of neighboring fins define a particle-collection trap.

Preferably, each rib has an end portion surrounded by a respective particle-collection trap.

Preferably, the fins extend beyond an upstream side of the particle-collection slot.

Preferably, each fin has a chamfered upstream end portion.

Preferably, upper surfaces of the ribs, dam wall and fins are coplanar.

As used herein, the term "printer" refers to any printing device for marking print media, such as conventional desktop printers, label printers, duplicators, copiers and the like. In one embodiment, the printer is a sheet-fed printing device.

As used herein, the term "ink" refers to any printable fluid, including conventional dye-based and pigment-based inks, infrared inks, UV curable inks, 3D printing fluids, biological fluids, colorless ink vehicles etc.

BRIEF DESCRIPTION OF THE DRAWINGS

Embodiments of the present invention will now be described by way of example only with reference to the accompanying drawings, in which.

DETAILED DESCRIPTION OF THE INVENTION

First Embodiment

Figure 1:
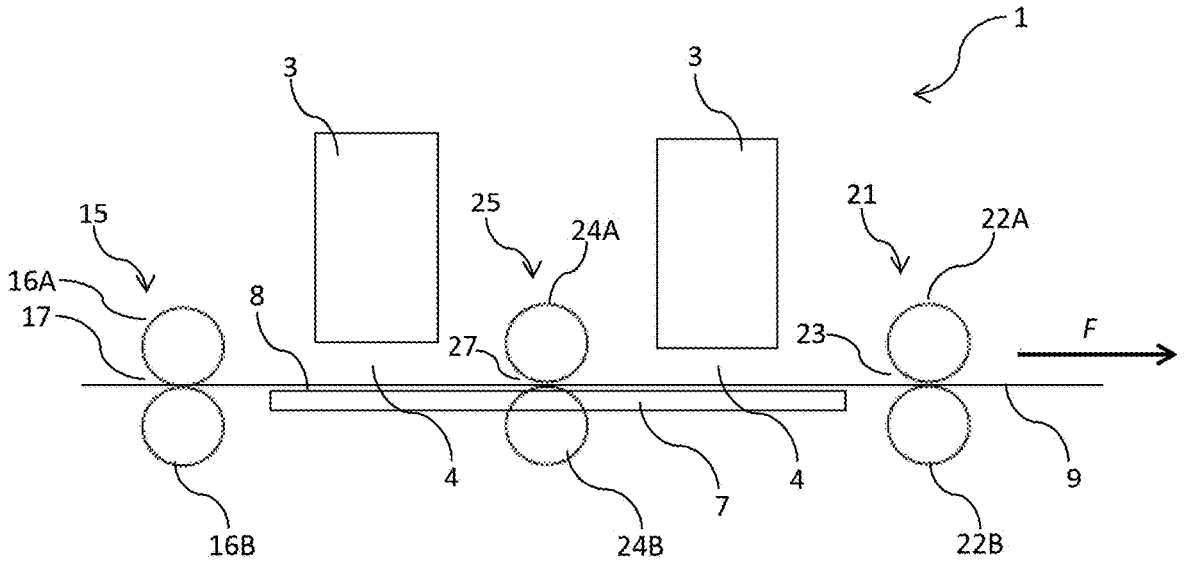
FIG. 1 is a schematic side view of a printer having two printheads and a platen.

Referring to FIG. 1, there is shown a printer 1 comprising first and second fixed printheads 3, one positioned downstream of the other relative to a media feed direction F. A fixed vacuum platen 7 is positioned beneath the printheads for supporting sheets of print media 9 (e.g. paper) fed through respective print zones 4 of the printheads. The platen 7 has an upper platen surface 8 configured such that media sheets 9 are fed in a horizontal trajectory past the printheads 3, with the platen providing a suction force for drawing print media against the platen surface. Accordingly, print media are stably supported flat against the platen 7 as the media travels through the spaced apart print zones 4 of respective printheads 3.

The platen 7 may be liftable towards and away from the printheads 3 to enable capping and/or maintenance interventions when required, or to clear paper jams. A suitable arrangement for lifting and translating a platen to enable maintenance and/or capping interventions is described in U.S. Pat. No. 8,523,316, the contents of which are incorporated herein by reference. Additionally or alternatively, each printhead 3 may be liftable towards and away from the platen 7. A suitable arrangement for lifting and translating a printhead to enable maintenance and/or capping interventions is described in U.S. Pat. No. 9,061,531, the contents of which are incorporated herein by reference.

Figure 2:
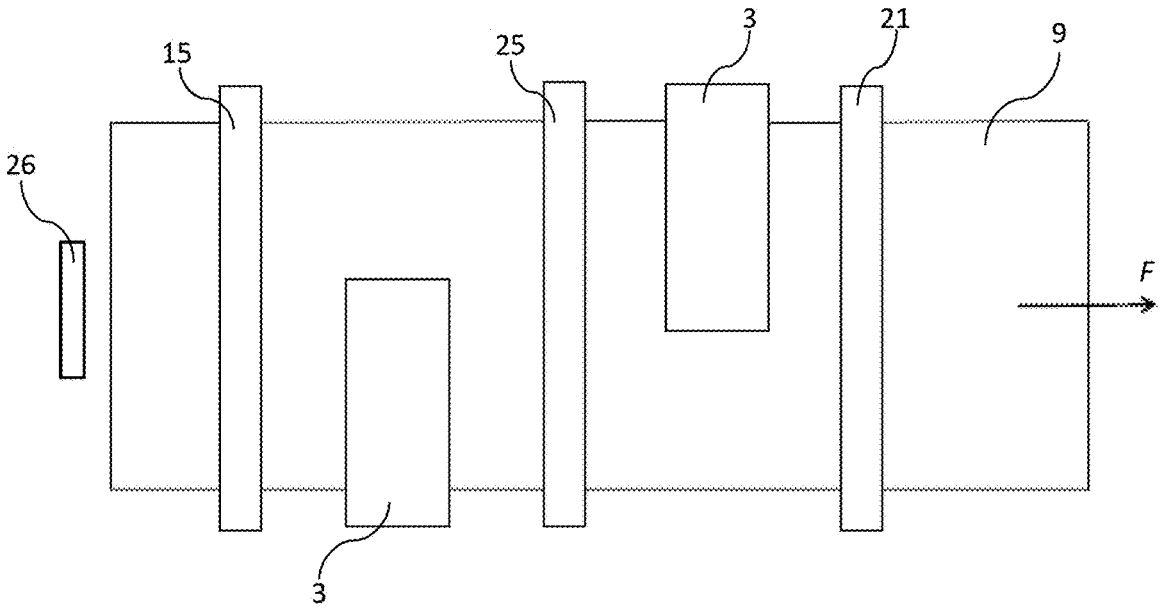
FIG. 2 is a schematic plan view of the printer shown in FIG. 1.

As shown in FIG. 2, the printheads 3 partially overlap in the media feed direction F, with each printhead printing about half of the image (not shown). Suitable algorithms may be employed to mask any stitching artifacts between the two printheads using techniques known in the art (see, for example, U.S. Pat. No. 6,394,573, the contents of which are incorporated herein by reference). Accordingly, a pair of overlapping A4-sized printheads may, for example, be used to print onto A3 sheets.

An input roller assembly 15 is comprised of one or more pairs of input rollers (upper input roller 16A and lower input roller 16B) positioned upstream of the platen 7. The input roller assembly 15 receives a leading edge of the media sheet 9 and is configured to feed the sheet along the media feed direction F towards the print zone 4 of the upstream printhead. An output roller assembly 21 is comprised of one or more pairs of output rollers (upper output roller 22A and lower output roller 22B) positioned downstream of the platen 7 relative to the media feed direction F. The output roller assembly 21 is configured for receiving the media sheet 9 from the platen 7 and transporting the sheet into an exit tray (not shown) of the printer 1. An intermediary roller assembly 25 is embedded at least partially within the platen 7 and is comprised of pairs of intermediary rollers (upper intermediary roller 24A and lower intermediary roller 24B) positioned between the two printheads 3. The intermediary roller assembly 25 is configured for receiving the media sheet 9 from the first input roller assembly 15 and feeding the sheet towards the output roller assembly 21.

The input roller assembly 15, intermediary roller assembly 25 and output roller assembly 21 together form part of a media feed mechanism of the printer 1. The media feed mechanism typically comprises other components, such as a media picker 26 (FIG. 2), as is known in the art. Further, each roller assembly may comprise a single roller extending across a media width or multiple rollers spaced apart across the media width.

Figure 3:
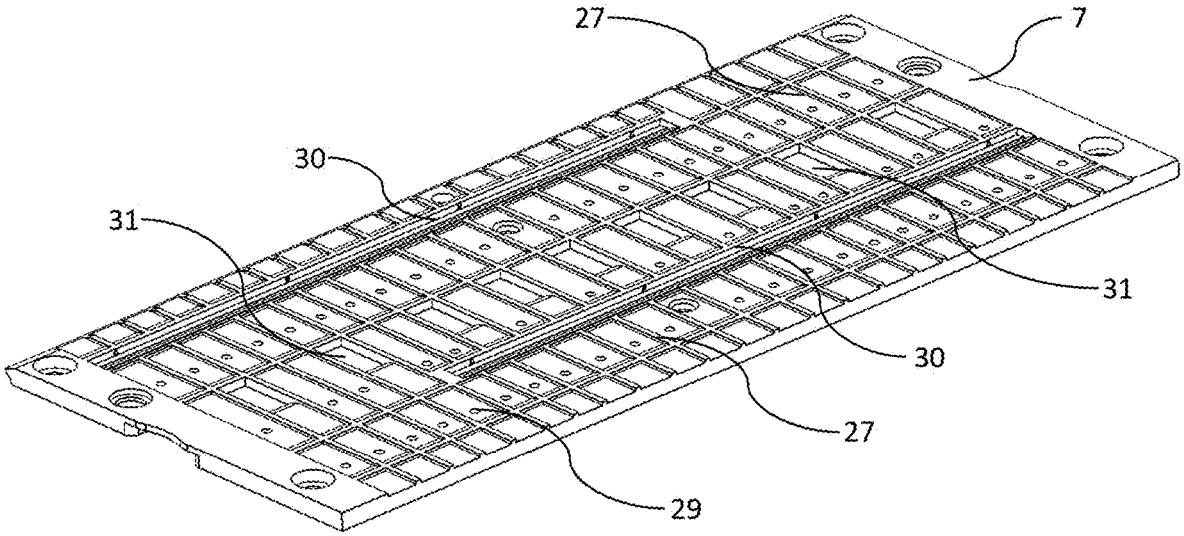
FIG. 3 is a bottom perspective of a platen according to a first embodiment.
Figure 4:
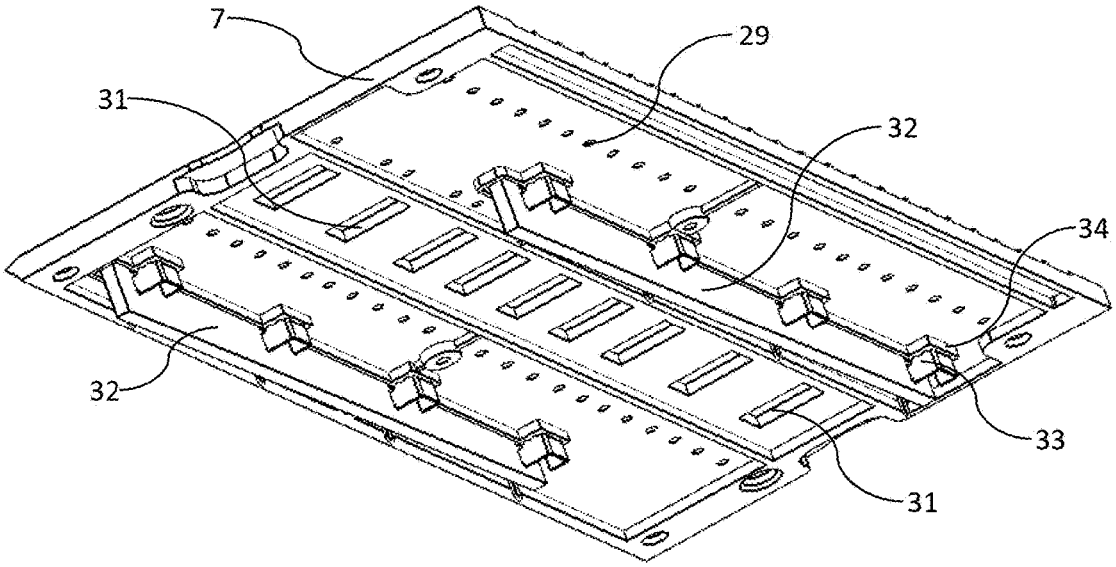
FIG. 4 is a bottom perspective of the platen shown in FIG. 3.
Figure 5:
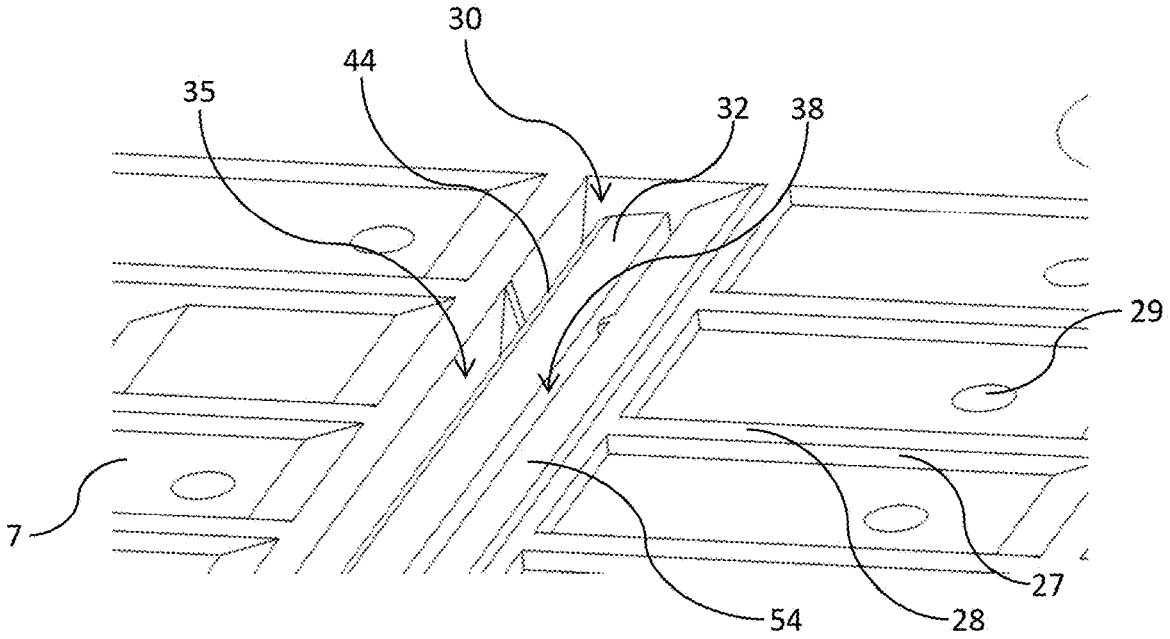
FIG. 5 is a magnified top perspective of an ink-collection slot and wick bar.

Referring now to FIGS. 3 to 6, the platen 7 according to the first embodiment is generally planar and defines a pair of overlapping ink-collection slots 30, each extending partially across a width of the platen. The platen surface 8 comprises a plurality of ribs 27, each having an upper rib surface 28 for low-friction contact with the media sheet 9. A plurality of vacuum apertures 29 positioned between the ribs 27 provide a vacuum force drawing the media sheet 9 onto the upper rib surfaces 28, which together define the platen surface 8. As best shown in FIGS. 3 and 4, a number of roller openings 31 are positioned across a mid-portion of the platen 7 (between the ink-collection slots 30) for receiving the lower intermediary rollers 24B embedded within the platen.

Each ink-collection slot 30 contains a wick bar 32, which is aligned with a respective printhead 3 positioned over the wick bar during printing. The wick bars 32 are fixed within a respective ink-collection slot 30 by support arms 33 engaged with a body of the wick bar. The support arms 33 are fixedly mounted to an underside of the platen 7 via mounting brackets 34.

Each wick bar 32 is typically comprised of a bar of absorbent material, which absorbs ink droplets and wicks them away from the printhead 3. The wick bar 32, therefore, serves as a spittoon for the printhead 3 by receiving spitted ink droplets during print jobs. For example, it is usually necessary to fire each nozzle of the printhead 3 periodically in order to maintain optimum nozzle health and this may be achieved by intra-page spitting into the spittoon. Additionally, the wick bar 32 and ink-collection slot 30 are configured to encourage maximum collection of aerosol ("ink mist") from the vicinity of the printhead during printing, as will be explained in more detail below.

Figure 6:
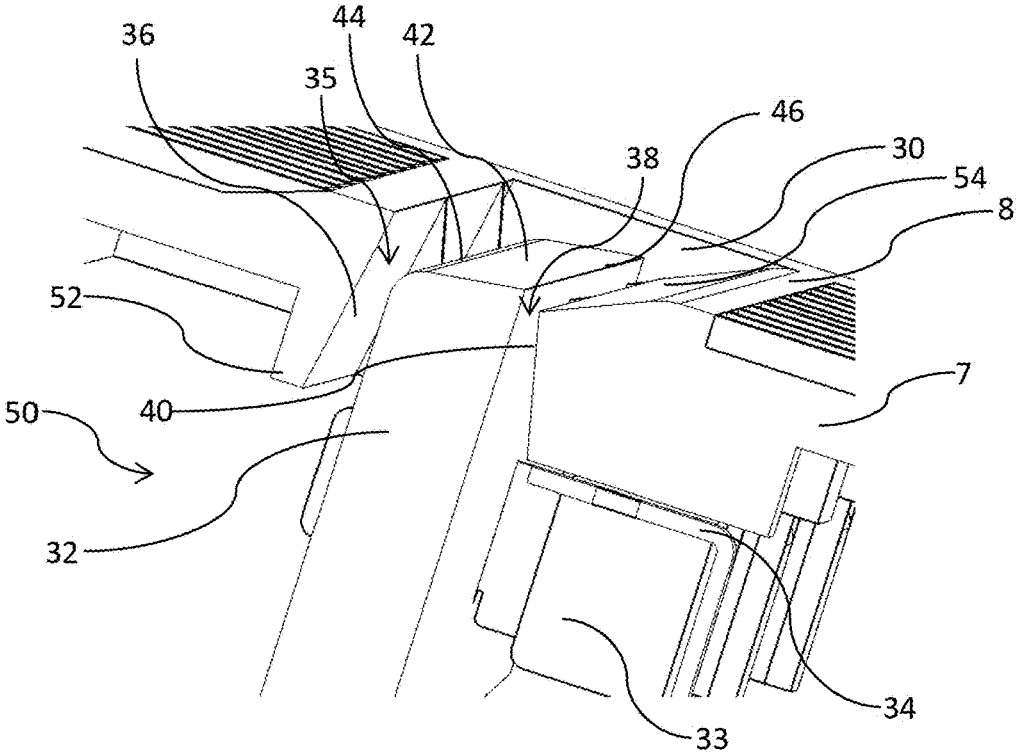
FIG. 6 is a sectional perspective of the ink-collection slot and wick bar.

As best shown in FIG. 6, an upstream gap 35 is defined between the wick bar 32 and an upstream sidewall 36 of the ink-collection slot 30; similarly, a downstream gap 38 is defined between the wick bar 32 and a downstream sidewall 40 of the ink-collection slot 30. Several features of wick bar 32 are designed to encourage airflow (and mistflow) preferentially into the upstream gap 35 during use. Firstly, an upper wick surface 42 of the wick bar 32 is gently sloped downwards from the downstream gap 38 towards the upstream gap 35. Typically, the slope is in the range of 1 to 10 degrees; in the embodiment shown the slope is about 4 degrees although the skilled person will readily appreciate that the slope may be varied to optimize performance. Secondly, the wick bar 32 is positioned in the ink-collection slot 30 such that an upstream gap 35 is relatively wider than the downstream gap 38. Thirdly, an upstream uppermost longitudinal edge region 44 of the wick bar 32 has a curved profile in contrast with a downstream uppermost longitudinal edge 46 having an angular profile. Furthermore, flaring of ink-collection slot sidewalls 36 and 40 towards a first vacuum chamber 50 below the platen 7 encourages airflow from the platen surface 8 towards the first vacuum chamber and minimizes ink blockages in the upstream gap 35 and downstream gap 38. A lower end 52 of each sidewall 36 and 40 projects into the first vacuum chamber 50 and functions as a guard to minimize ink wicking onto a lower surface of the platen 7 during use.

The entire upper wick surface 42 of the wick bar 32 is positioned below the platen surface 8 so that undesirable fouling of the underside of print media is avoided. Furthermore, a shallow chamfer 54 from the platen surface 8 towards the downstream sidewall 40 is configured to deflect a leading edge of print media onto the platen surface 8 and minimizes potential paper jams caused by print media entering the ink-collection slot 30. Typically, the angle of chamfer is between 5 and 20 degrees.

Figure 7:
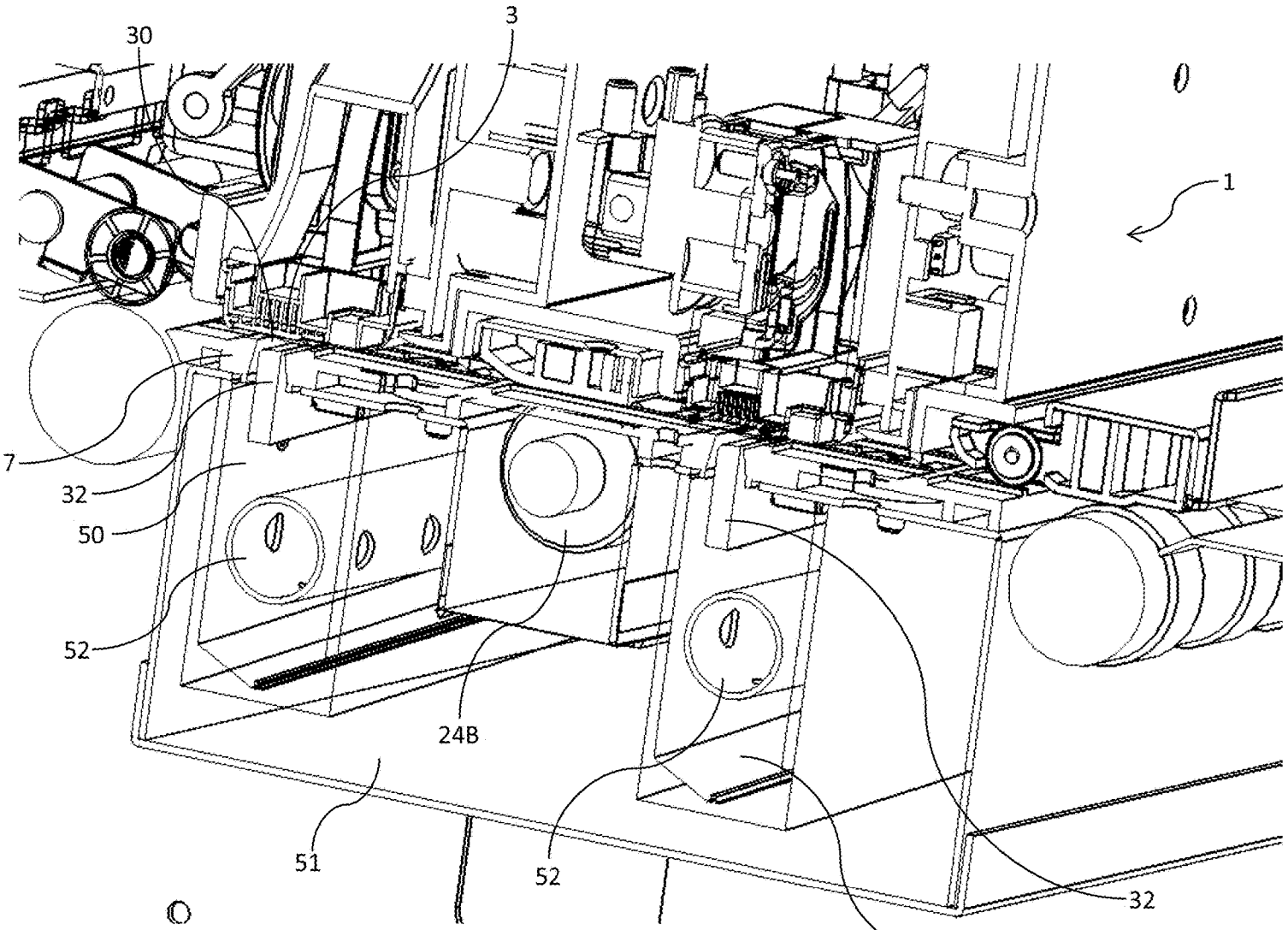
FIG. 7 is a sectional side perspective of a print engine.

FIG. 7 is a sectional side perspective of the printer 1 showing first vacuum chambers 50 associated with each wick bar 32. Each first vacuum chamber 50 contains an apertured rod 52 connected to a vacuum source (not shown), which provides an appropriately controlled vacuum pressure for each ink-collection slot 30.

A second vacuum chamber 51 is fluidically isolated from the first vacuum chamber 50 and provides a vacuum pressure for the vacuum apertures 29, which draw print media onto the platen surface. Typically, the vacuum pressure required for optimum ink mist collection through the ink-collection slot 30 is less than the vacuum pressure required at the vacuum apertures 29 for optimum media stability. Accordingly, the first vacuum chambers 50 and the second vacuum chamber 51 are typically connected to separate vacuum sources.

Second Embodiment

Figure 8:
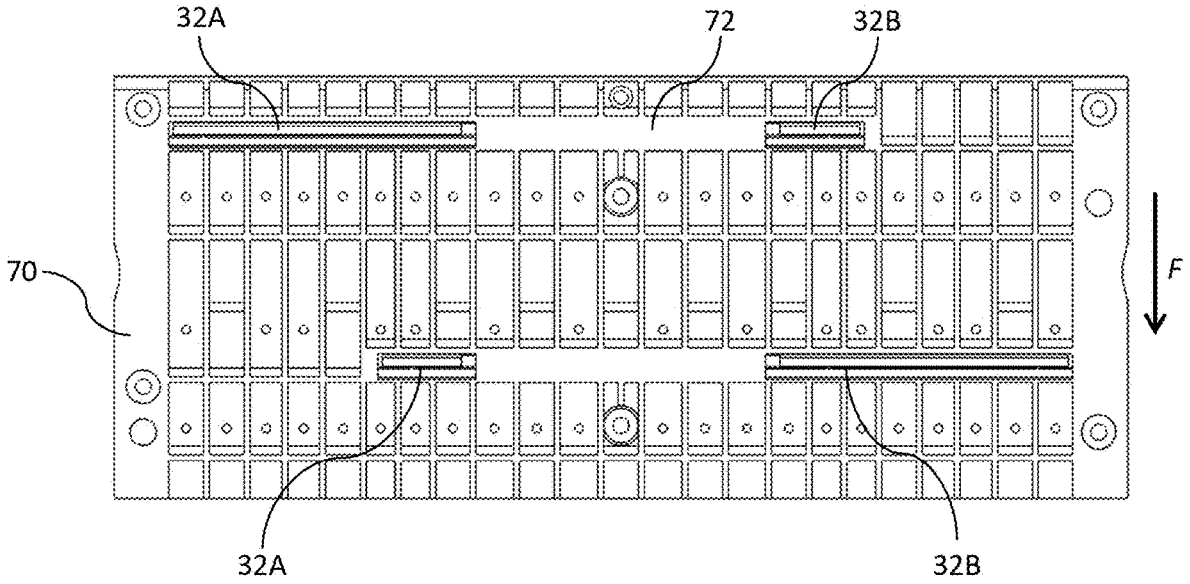
FIG. 8 is a top view of a platen according to a second embodiment.
Figure 9:
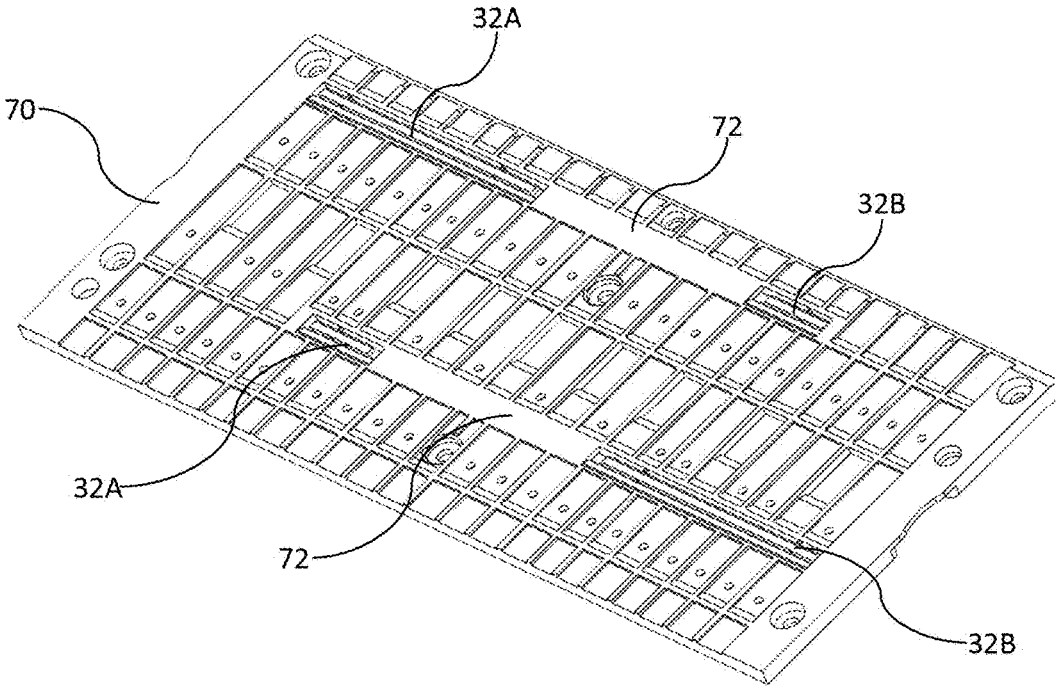
FIG. 9 is a perspective view of the platen shown in FIG. 8.

FIGS. 8 and 9 show a platen 70 according to a second embodiment. In the platen 70 according to the second embodiment, each wick bar 32 is split into two sections 32A and 32B with a mid-portion 72 of the platen being absent the wick bar (and ink-collection slot 30). Hence, the printheads 3 each have a corresponding portion which does not overlie a wick bar in the mid-portion 72 of the platen 70. The mid-portion 72 of the platen 70 is aligned in the media feed direction F with the media picker 26, which is positioned in a corresponding mid-portion of the media feed path upstream of the platen. The media picker 26 typically generates paper dust upstream, which accumulates primarily in the mid-portion 72 of the platen. In the platen 7 according to the first embodiment, the paper dust may become lodged in the upstream and downstream gaps 35 and 38, as well as accumulated on the upper wick surface 42 of the wick bar 32. This accumulated paper dust, when mixed with ink, may cause undesirable ink smearing on the underside of the media sheets 9. However, in the alternative platen 70 according to the second embodiment, the mid-portion 72 is absent the wick bar 32 meaning that paper dust concentrated in this region cannot accumulate on the wick bar or become lodged in the upstream and downstream gaps 35 and 38. The platen 70 according to the second embodiment, therefore, advantageously minimizes ink smearing on the underside of media sheets 9 compared to the platen 7 according to the first embodiment.

Third Embodiment

A potential disadvantage of the platen 70 according to the second embodiment is that the ink-collection slot 30 cannot fulfil a spittoon function in the mid-portions 72 where the ink-collection slot is absent. In this case, intra-page spitting may be used to maintain optimum nozzle health without reliance on any inter-page spitting.

Figure 10:
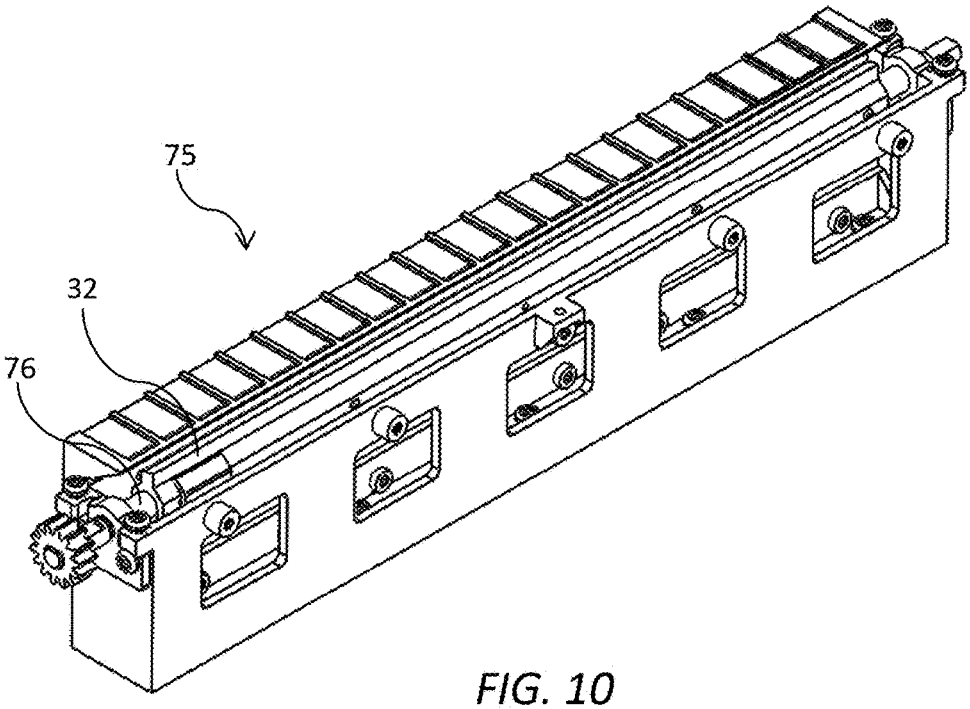
FIG. 10 is a perspective view of part of a platen having a rotatable wick bar.
Figure 11A:
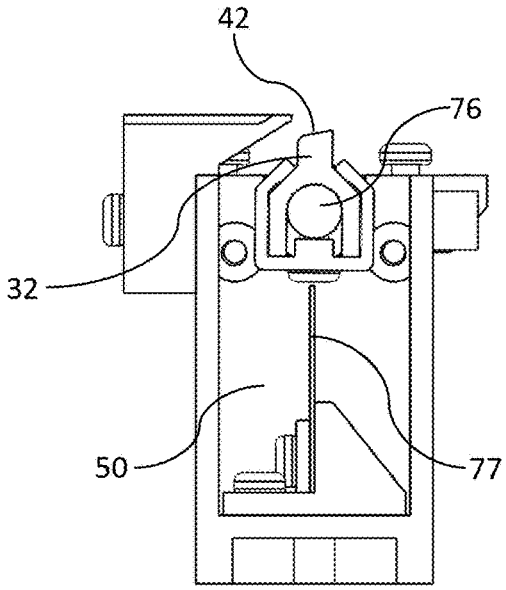
FIGS. 11A and 11B show the rotatable wick bar in printing and cleaning positions.
Figure 11B:
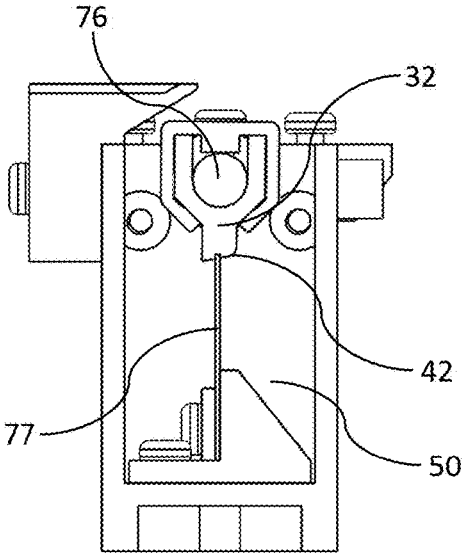

Alternatively or additionally, the problem of paper dust mixing with ink on the wick bar 32 may be addressed by the third embodiment shown in FIGS. 10 and 11. FIG. 10 shows part of a platen 75 according to the third embodiment where the wick bar 32 is mounted on a rotatable shaft 76. Referring to FIGS. 11A and 11B, a scraper 77 is positioned in the vacuum chamber 50 for scraping the upper wick surface 42 of the wick bar 32 as it rotates past the scraper. FIG. 11A shows the wick bar 32 in its home (printing) position for optimal ink mist collection as described above, while FIG. 11B shows the wick bar in a cleaning position with the wick bar halfway through a revolution and the scraper 77 scraping the upper wick surface 42. Accordingly, periodic rotation of the wick bar 32 may be used to clean paper dust or other particulates from the upper wick surface 42, thereby minimizing problems associated with ink and paper dust mixin.

Fourth Embodiment

A potential disadvantage of the platen 75 according to the third embodiment is the increased mechanical complexity of the design and the requirement for periodic rotation of the wick bar 32. In the platen 80 according to the fourth embodiment shown in FIGS. 12 to 14, particles swept along the platen towards the print zone 4 are trapped by a particle-collection slot 82 upstream of the print zone. Several features of the platen 80 encourage removal of particles (e.g. paper dust) entrained in the airflow of print media before they reach print zone 4. The particle-collection slot 82, therefore, is designed to protect the print zone 4 by minimizing mixing of particles and ink mist, and thereby reduces ink streaks on the print media.

Figure 12:
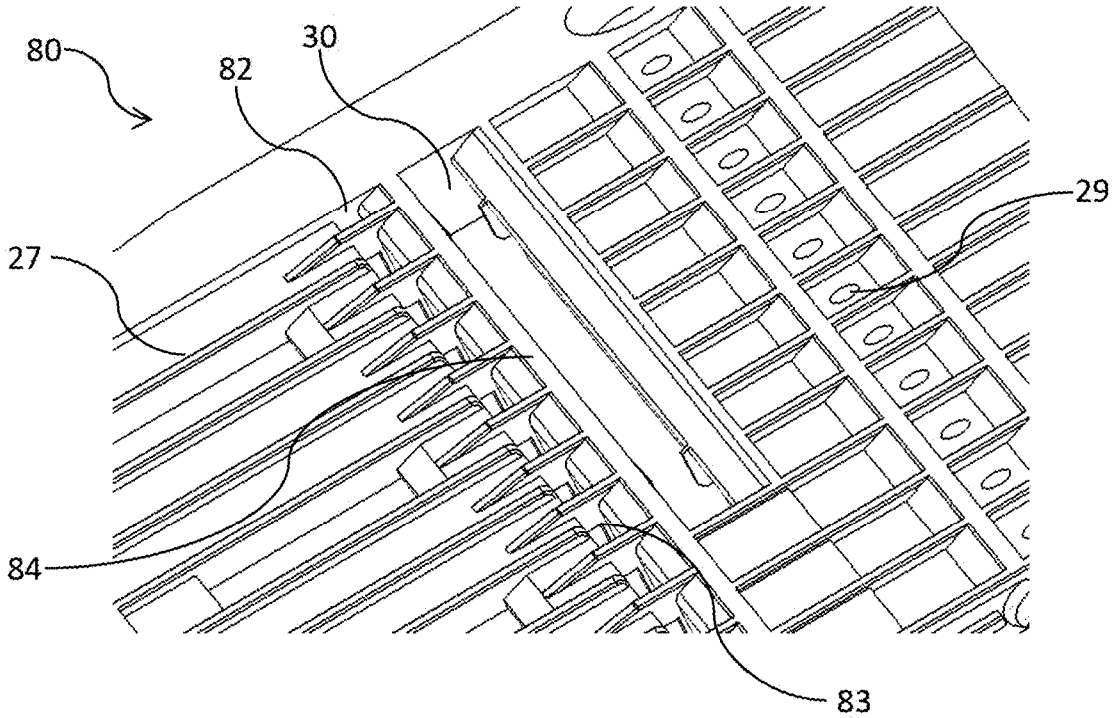
FIG. 12 is a perspective of part of a platen having particle-collection traps.

FIG. 12 shows a portion of the platen 80 having the particle-collection slot 82 upstream of the ink-collection slot 30 (which may contain the wick bar 32) positioned in the print zone 4. A dam wall 84 extends across the platen 80 perpendicular to the media feed direction and divides the ink-collection slot 30 from the particle-collection slot 82.

Figure 13:
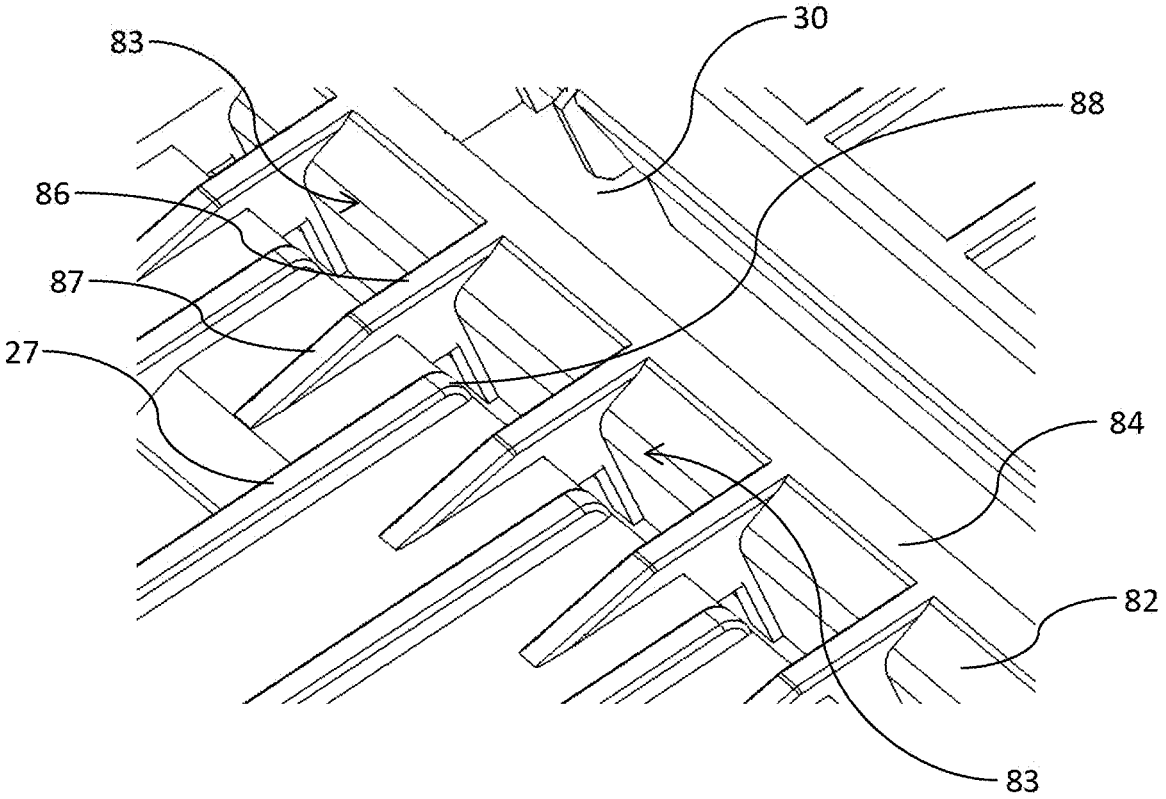
FIG. 13 is a magnified view of the particle-collection traps shown in FIG. 12.

The ribs 27 extend longitudinally along the platen 80 parallel with the media feed direction towards the dam wall 84. In order to maximize removal of particles via the particle-collection slot 82, the particle-collection slot is divided into a plurality of discrete particle-collection traps 83. As shown in FIGS. 12 and 13, a plurality of fins 86 extend from the dam wall 84 in an upstream direction so as to bridge across the particle-collection slot 82. Upper surfaces of the ribs 27, dam wall 84 and fins 86 are all coplanar for supporting print media conveyed along the platen 80.

Each particle-collection trap 83 is defined by part of the dam wall 84 and a pair of neighboring fins 86. The fins 86 are positioned midway between pairs of ribs 27, such that the fins and ribs are interfingered along an upstream side of the particle-collection slot 82. This arrangement maximizes trapping of particles, which tend to travel longitudinally alongside the ribs 27. Hence, particles travelling alongside opposite sides of each rib 27 enter the particle trap 83 and either strike the dam wall 84 and/or are suctioned directly into particle-collection slot 82. A chamfered upstream end portion 87 of the fins 86 together with a downwardly curved downstream end portion 88 of the ribs 27 further encourage particles to enter the particle-collection traps 83.

The particle-collection traps 83 are typically in fluid communication with the second vacuum chamber 51, which controls the vacuum pressure of the vacuum apertures 29.

Figure 14:
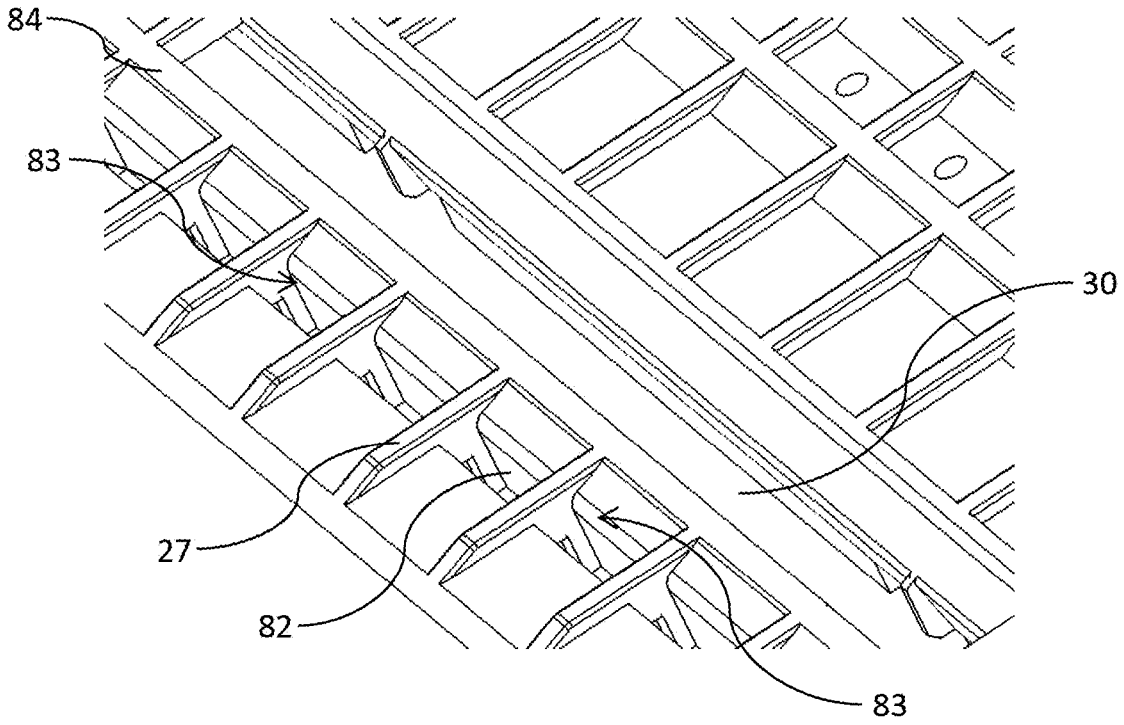
FIG. 14 is a perspective of part of a platen having alternative particle-collection traps.

FIG. 14 shows an alternative configuration of the particle-collection traps 83 in which the fins 86 are absent and the ribs 27 bridge across the particle-collection slot 82 to meet with the dam wall 84.

Computer Simulation

Figure 15:
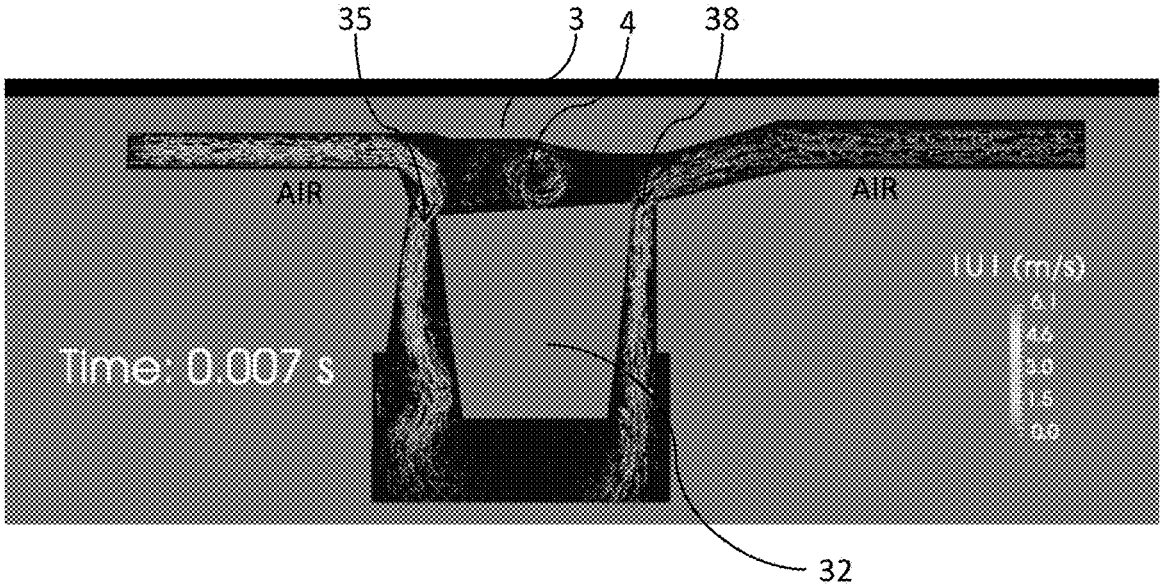
FIG. 15 shows a computer model of airflow around the wick bar.
Figure 16:
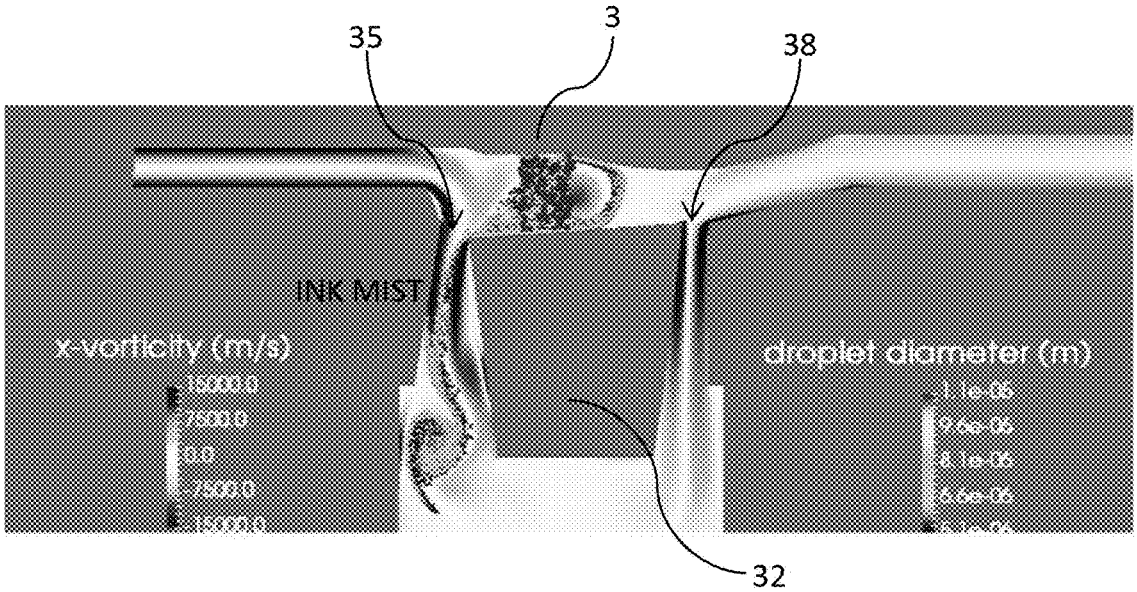
FIG. 16 shows a computer model of mist flow around the wick bar.

FIGS. 15 and 16 show the Applicant's computer modelling of airflow and mistflow around the wick bar 32, as described herein in connection with FIGS. 3 and 4. From FIG. 10, it can be seen that the wick bar 32 preferentially directs airflow into the upstream gap 35 away from the print zone 4. Similarly, and referring to FIG. 11, ink mist generated in the region of the print zone 4 is directed preferentially into the upstream gap 35.

Mist Level Measurements

Figure 17:
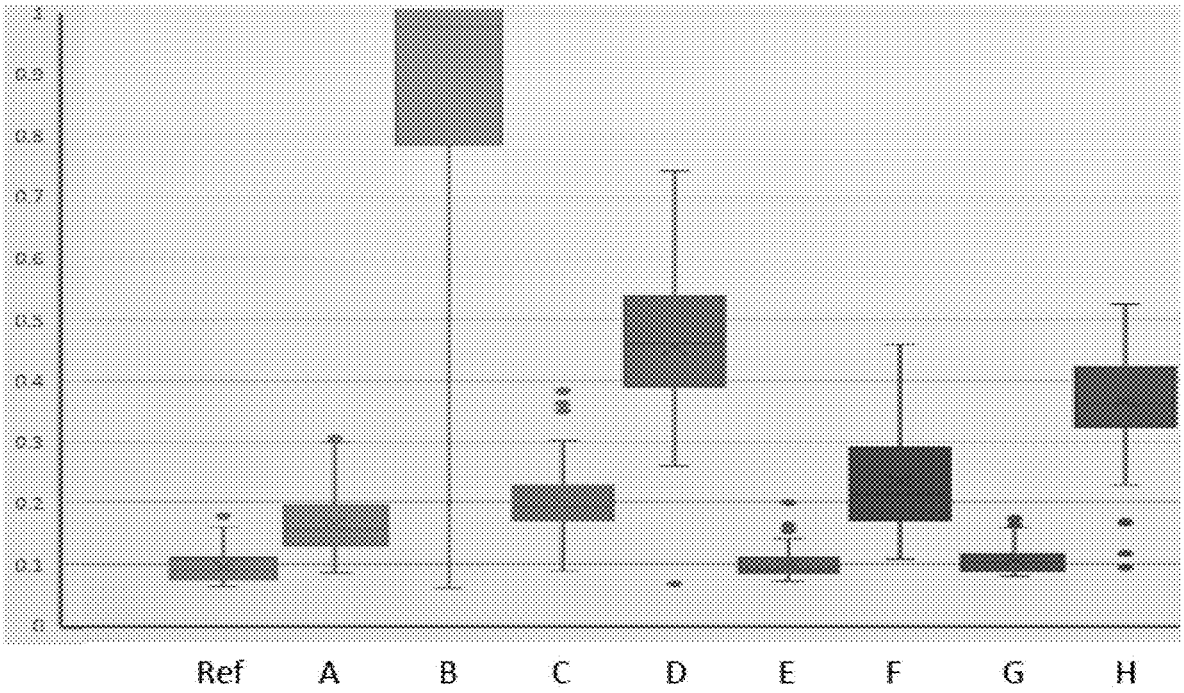
FIG. 17 is a graph showing results from various mist level measurements.

The efficacy of the wick bar 32 shown in FIGS. 3 and 4 was tested in a first test printer ("Machine 1") of the type shown in FIG. 7. The test printer ("Machine 1") was fitted with Dusttrak™ aerosol monitor positioned to measure ink mist in the vicinity of each printhead 3 ("Printhead 1" and "Printhead 2"). Two test images were printed in separate print runs onto A3 sheets using Machine 1. Mist levels in the vicinity of Printhead 1 and/or Printhead 2 were measured every second during the print run. By way of comparison, an otherwise identical test printer ("Machine 2") having no wick bar 32 was used to print the same test images. A reference ink mist level measurement was also recorded with no printing. The results of these mist level measurements are shown in Table 1 below and FIG. 17 summarizes the mist level measurements in Table 1.

TABLE 1

| Mist level measurements | | | | |
|---|---|---|---|---|
| Print Run | Test Image | Printer | Printhead 1, mist level range ($mg/m^3$) | Printhead 2, mist level range ($mg/m^3$) |
| Reference | None | | 0.08-0.11 | 0.08-0.11 |
| A | Image 1 | Machine 1 | not measured | 0.13-0.20 |
| B | Image 1 | Machine 2 | not measured | 0.79-1.11 |
| C | Image 2 | Machine 1 | | 0.18-0.22 |
| D | Image 2 | Machine 2 | | 0.39-0.53 |
| E | Image 2 | Machine 1 | 0.09-0.11 | |
| F | Image 2 | Machine 2 | 0.18-0.29 | |
| G | Image 2 | Machine 1 | 0.09-0.11 | |
| H | Image 2 | Machine 2 | 0.33-0.42 | |

From these results, it can be clearly seen that the test printer having a wick bar 32 ("Machine 1") consistently outperforms the same test printer having no wick bar ("Machine 2"). In particular, print runs A, C, E and G on Machine 1 exhibited significantly lower mist levels than print runs B, D, F and H on Machine 2. The results were particularly surprising in light of the fact that opportunities for mist extraction only exist between media sheets when the ink-collection slots are not covered by the print media. Nonetheless, Machine 1 was remarkably effective in reducing ink mist in the vicinity of the printheads 3. Notably, ink mist levels were comparable to reference mist levels for Printhead 2 in print runs E and G. It was therefore concluded that the printer and wick bar arrangement according to the present invention had significant and surprising advantages in terms of mist extraction.

Although the present invention has been described with reference to two overlapping fixed printheads, it will of course be appreciated that the invention may be applicable to any number of printheads (i.e. one or more) arranged along a media feed path. In the case of multiple printheads, the printheads may be overlapping, non-overlapping or aligned.

It will, of course, be appreciated that the present invention has been described by way of example only and that modifications of detail may be made within the scope of the invention, which is defined in the accompanying claims.

This invention claimed is:

1. A printer comprising:

a printhead;

a platen positioned below the printhead for supporting print media conveyed along a media feed direction through a print zone, the platen defining at least one particle-collection slot upstream of the print zone relative to the media feed direction and an ink-collection slot positioned in the print zone downstream of the particle-collection slot, wherein a dam wall is positioned between the particle-collection slot and the ink-collection slot, the dam wall extending transversely relative to the media feed direction.

2. The printer of claim 1, wherein a wick bar is received within the ink-collection slot.

3. The printer of claim 1, wherein the particle-collection slot is divided into a plurality of discrete particle-collection traps.

4. The printer of claim 1, wherein the platen has ribs for supporting print media and wherein upper surfaces of the ribs and the dam wall are coplanar.

5. The printer of claim 4, wherein each rib bridges across the particle-collection slot and meets with the dam wall.

6. The printer of claim 4, wherein each rib terminates at an upstream side of the particle-collection slot.

7. The printer of claim 6, wherein each rib has an end portion curved downwards towards the particle-collection slot.

8. The printer of claim 6, wherein a plurality of fins extend from the dam wall parallel with the ribs, each fin bridging across the particle-collection slot.

9. The printer of claim 8, wherein the fins are offset from the ribs.

10. The printer of claim 9, wherein each rib is disposed midway between a pair of fins.

11. The printer of claim 8, wherein upper surfaces of the ribs, dam wall and fins are coplanar.

12. A platen for supporting print media fed along a media feed direction in an inkjet printer, said platen defining at least one particle-collection slot upstream of a print zone relative to the media feed direction and an ink-collection slot positioned in the print zone downstream of the particle-collection slot, wherein a dam wall is positioned between the particle-collection slot and the ink-collection slot, the dam wall extending transversely relative to the media feed direction.

13. The platen of claim 12, wherein the particle-collection slot is divided into a plurality of discrete particle-collection traps.

14. The platen of claim 12, wherein the platen has ribs for supporting print media and wherein upper surfaces of the ribs and the dam wall are coplanar.

15. The platen of claim 14, wherein each rib bridges across the particle-collection slot and meets with the dam wall.

16. The platen of claim 14, wherein each rib terminates at an upstream side of the particle-collection slot.

17. The platen of claim 16, wherein each rib has an end portion curved downwards towards the particle-collection slot.

18. The platen of claim 16, wherein a plurality of fins extend from the dam wall parallel with the ribs, each fin bridging across the particle-collection slot.

19. The platen of claim 18, wherein the fins are offset from the ribs.

20. The platen of claim 19, wherein each rib is disposed midway between a pair of fins.

* * * * *